US006186855B1

(12) United States Patent
Bauer et al.

(10) Patent No.: US 6,186,855 B1
(45) **Date of Patent: *Feb. 13, 2001**

(54) SET OF ELEMENTS ARTICULATED TO EACH OTHER

(75) Inventors: Jean Bauer, Auvernier; Jean-Philippe Lebet, Les Geneveys-sur-Coffrane, both of (CH)

(73) Assignee: Trigam S.A., Neuchatel (CH)

( * ) Notice: Under 35 U.S.C. 154(b), the term of this patent shall be extended for 0 days.

This patent is subject to a terminal disclaimer.

(21) Appl. No.: 09/289,843

(22) Filed: Apr. 12, 1999

Related U.S. Application Data

(62) Division of application No. 08/808,006, filed on Mar. 3, 1997, now Pat. No. 6,116,980.

(30) Foreign Application Priority Data

May 17, 1994 (CH) ..... 01522/94

(51) Int. Cl.[7] ..... A63H 33/08

(52) U.S. Cl. ..... 446/104; 446/115; 446/116; 446/120

(58) Field of Search ..... 446/85, 102, 104, 446/108, 115, 116, 120, 121; 273/156, 153 P

(56) References Cited

U.S. PATENT DOCUMENTS 2,776,521 * 1/1957 Zimmerman .
2,814,159 * 11/1957 Green .
4,055,019 * 10/1977 Harvey .
4,090,322 * 5/1978 Hake .
4,731,041 * 3/1988 Ziegler ..... 446/115
4,792,319 * 12/1988 Svagerko ..... 446/104
4,874,341 * 10/1989 Ziegler ..... 446/109
5,100,358 * 3/1992 Volgger ..... 446/104
5,183,430 * 2/1993 Swann ..... 446/104

FOREIGN PATENT DOCUMENTS

108903 * 2/1968 (DK) ..... 446/115
121433 * 10/1984 (EP) ..... 446/120

* cited by examiner

*Primary Examiner*—Jacob K. Ackun
*Assistant Examiner*—Jeffrey D. Carlson
(74) *Attorney, Agent, or Firm*—Davis and Bujold

(57) ABSTRACT

The four elements are each provided with protrusions constituted by forks the branches of which are resilient, which are each provided with a recess and with an embossment. These protrusions engage with each other, their embossments and their recesses hooking each other, and are thus articulated to each other around rotation axes. The series of protrusions and of the free spaces which separate them are determined in such a way that the four plates can be articulated to each other two by two, that has for consequence they can be articulated all the four to each other. With respect to a central axis, the half-series of each element are not symmetrical but they can be identical.

16 Claims, 14 Drawing Sheets

SET OF ELEMENTS ARTICULATED TO EACH OTHER

This is a Division application of Ser. No. 08/808,006 filed Mar. 3, 1997, now U.S. Pat. No. 6,116,980.

BACKGROUND OF THE INVENTION a) Field of the Invention

This invention relates to a set of elements presenting each at least one rectilinear edge along which the said elements are articulated to each other by means of protrusions provided on the said rectilinear edges, protrusions which intermesh with each other.

A set of elements articulated to each other such as mentioned hereabove can give raise to most diverses applications: toys, realization of scaled models, furniture like shelves and bookcasings, or structures of greater dimensions such as show-boothes for example. The application to toys constitutes, however, in the present case, the main object of the invention. In this case, the elements can be constituted by polygonal plates, mostly triangles which, articulated to each other, will permit the realization of pyramids or polyhedrons. These polyhedrons can be connected to each other by their edges, that permits to constitute other polyhedrons. Owing to the multiple articulations, the polyhedrons which are realized can also be provided with internal walls; in the case the faces of these polyhedrons, as well as their internal walls, are provided with openings, the game could consist in letting go spherical bodies, or of other shape, through these openings, or to secure thereto complementary members, according to specific rules. If the elements of the toy are provided with figurative or symbolic patterns, their set could constitute spatial puzzles, at three-dimensions, giving supplementary possibilities with respect to the conventional puzzles which are in a plane.

As a matter of fact, the number of the applications of such a set of elements articulated to each other, even restricted to toys, is tremendously high.

b) Description of the Prior Art

It is to be noted that it is already known to articulate elements to each other, even in the field of toys, by means of protrusions provided on a rectilinear edge of each element. However, in the known realizations, on the one hand one cannot connect more than two elements by keeping the character of an articulation, the elements being then merely assembled and not articulated, and, on the other hand, when they are more than two, their connection can be obtained only by means of one of the elements, which constitutes an intermediate connecting member, without all the elements of the set, whatever they can be, can be articulated, by pairs, two by two.

SUMMARY OF THE INVENTION

The object of the present invention is to provide a solution to this problem.

This object is achieved by the fact that the protrusions of the elements engage in each other.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
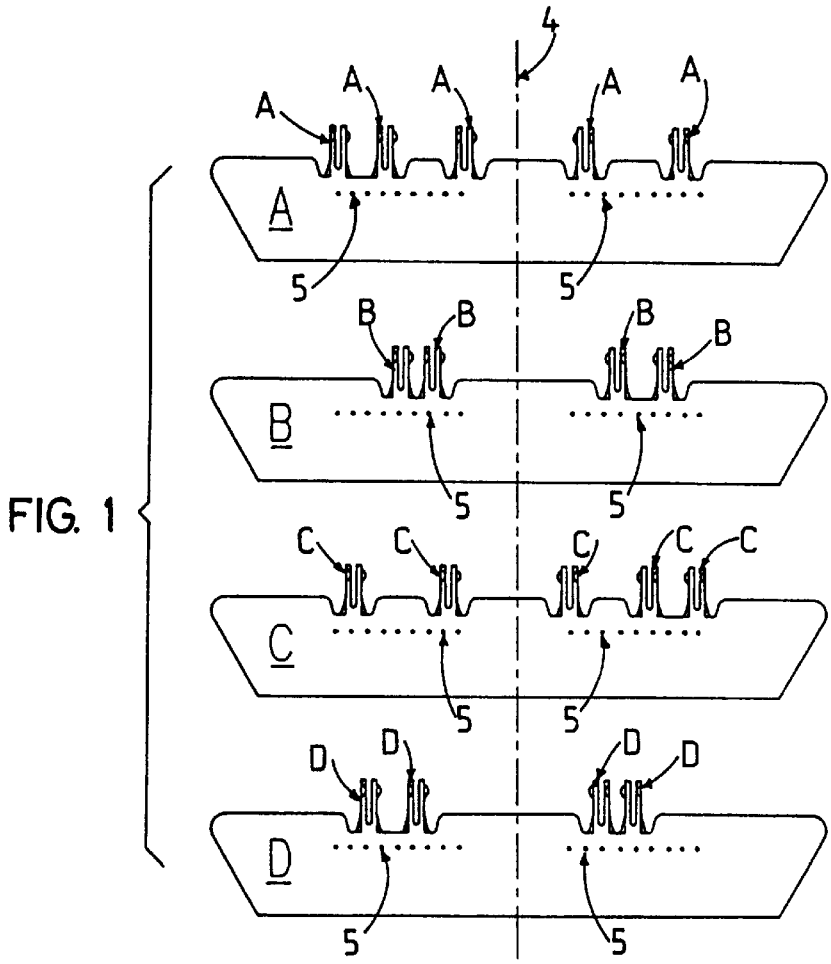
FIG. 1 shows a set of four plates able to be articulated to each other two by two, by pairs.

The four plates of FIG. 1, designated by references A, B, C and D, respectively, have been represented diagrammatically for illustrating the principle of the invention. They are able to be articulated to each other two by two, by pairs, and consequently are able to be articulated all the four to each other.

It is to be noted that, physically, the plates A and C are identical, but shown in the drawing turned over recto-verso one with respect to the other. One will say they are symmetrical one with respect to each other. It is the same for the plates B and D.

Figure 4:
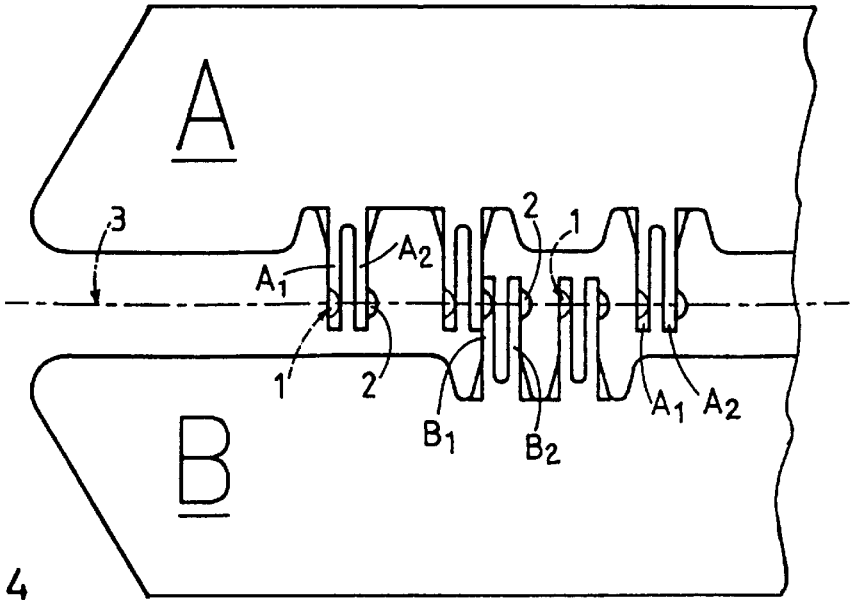
FIG. 4 is a view to s strongly enlarged scale of a portion of the two first plates of FIG. 3 illustrating the way the protrusions are hooked to each other.

One of the longitudinal rectilinear edges of these four plates is provided with protrusions designated by reference A for the plate A, by the reference B for the plate B, by the reference C for the plate C, and by the reference D for the plate D. These protrusions, which are visible to an enlarged scale in FIG. 4, are each made of a small tongue protruding on the rectilinear edge of the plate, and which is split longitudinally so that each protrusion is thus made of two branches $A_1$ and $A_2$, $B_1$ and $B_2$, $C_1$ and $C_2$, $D_1$ and $D_2$, which are resiliently deformable.

Figure 3:
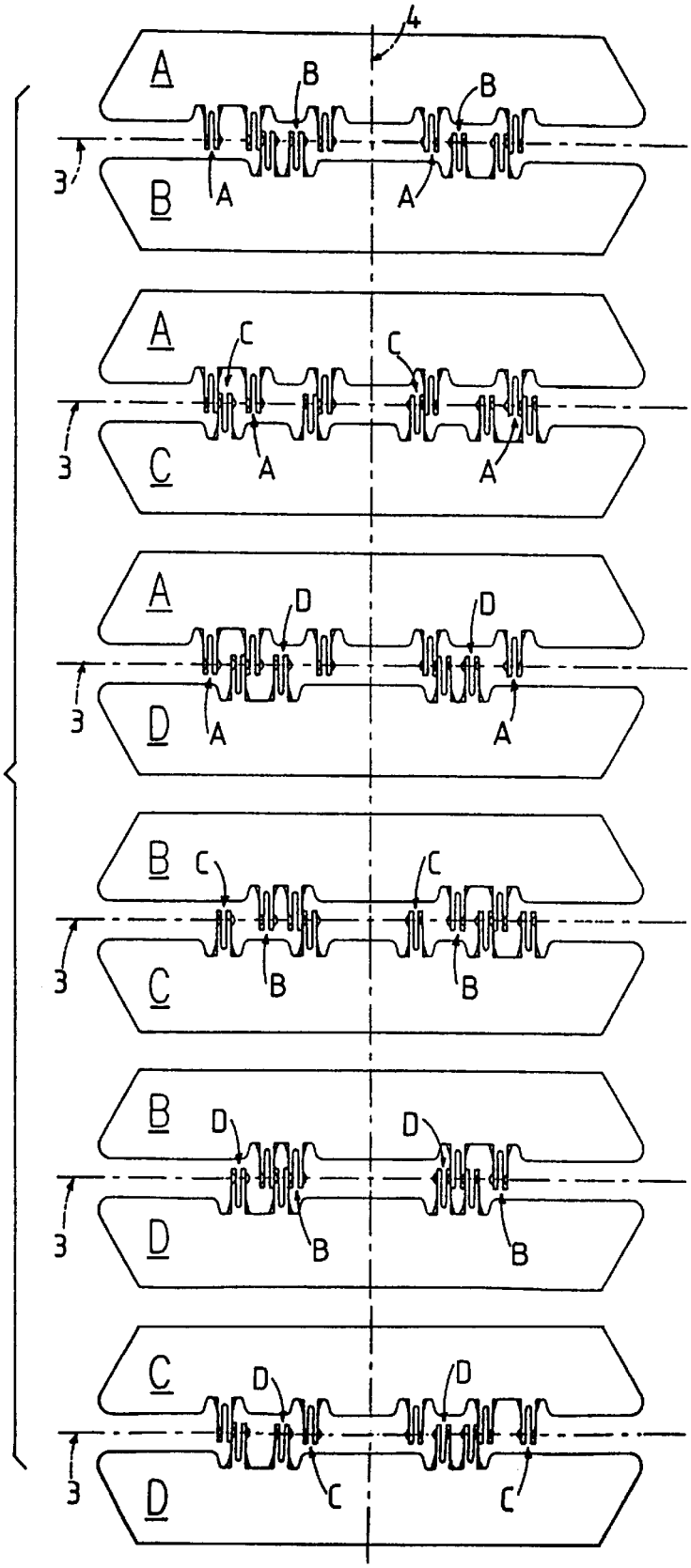
FIG. 3 shows the four plates of FIG. 1 articulated two by two.

The branches $A_1$, $B_1$, $C_1$ and $D_1$ are each provided, on their outer lateral face, with an hemispherical recess 1, while the branches $A_2$, $B_2$, $C_2$ and $D_2$ are provided, on their outer lateral face, with an hemispherical embossment 2. When the plates are assembled to each other, by reciprocal interengagement of their protrusions with each other, the embossment 2 of each protrusion engages the recesses 1 of an adjacent protrusion, that produces the assembling, in the mode of an articulation, of the plates to each other, the axis passing through all the recesses 1 and the embossments 2, designated by 3 in FIGS. 3 and 4, constituting the axis of articulation.

The protrusions A, B, C and D are all of the same width, this width constituting the unit of measuring of the free spaces or intervals separating the said protrusions from each other or separating the protrusions of the ends of the portions of the rectilinear edges of the plates on which said protrusions are distributed. These units of length, either occupied by protrusions or constituted by free spaces, will be called hereafter as being "positions". These positions have been indicated by points 5 in FIG. 1.

Figure 2:
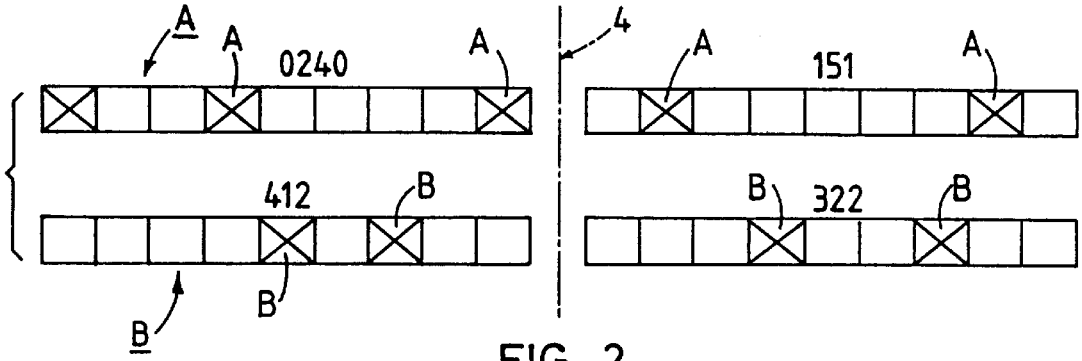
FIG. 2 is a diagrammatic representation of the series of the protrusions and of the free spaces of two of the four plates of FIG. 1.

FIG. 2 shows the series of positions on the plates A and B, the plates C and D being respectively identical, in the case of the present set of plates. One sees first that these series have eighteen positions. One sees then that they are arranged on both sides of an axis, designated by reference 4 in FIGS. 1 and 2, which passes through the middle of the rectilinear edge of the plates provided with these protrusions. One sees also that the half-series situated on both sides of the axis 4 are dissymmetrical with respect to this axis.

If one considers only the free spaces and gives thereto a data corresponding to their number, before, between or after the protrusions, one sees that the half-series of the left side of plate A, appearing in in the upper portion of FIG. 2, is expressed by 0240, while the half-series at the right side is expressed by 151, that is not symmetrical. It is the same so far as plate B is concerned, for which, as shown by the lower portion of FIG. 2, the half-series of the left side is expressed by 412 and the half-series of the right side by 322. Moreover, in the case of the plates A and B, and consequently of the plates C and D too, the two half-series situated on the both sides of the axis 4 are not only dissymmetrical, but also are different one from the other.

Figure 5:
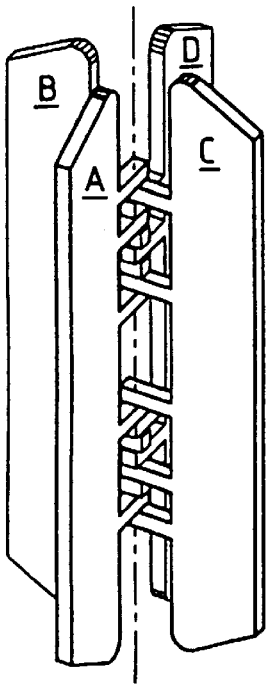
FIG. 5 shows the four plates of FIG. 1 articulated all the four to each other.
Figure 6:
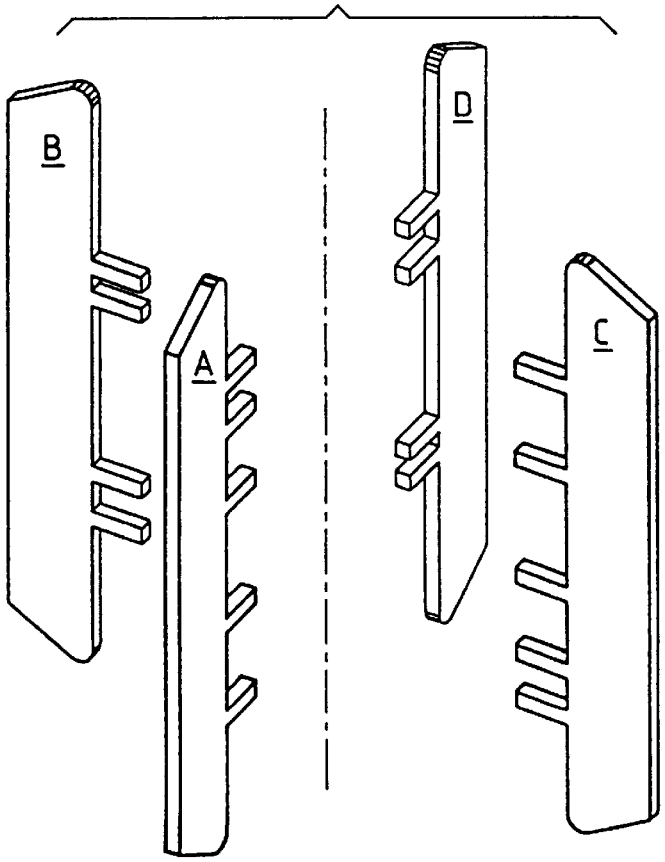
FIG. 6 is an exploded view of the four plates of FIG. 5.

FIGS. 5 and 6 show how the plates A, B, C and D can be articulated all the four, together, to each other.

It is to be noted that, in these figures, the protrusions A, B, C and D of these four plates have been represented diagrammatically while they are of the type represented in detail in FIG. 4.

One will also note that the disposition of the protrusions of the four plates A, B, C and D of the first embodiment is not the only one which permits the assembling two by two, by pairs, of four plates.

As a matter of fact, a general analysis of this first embodiment, i.e. a multiple articulation or hinge of four plates (N=4) permits to ascertain that several other arrangements of the protrusions can be used, the number of the positions being always, in this case, of eighteen ($P_{sym2.2}$= 18).

This number is depending from the fact that the symmetry between the plates A and C on the one hand and B and D on the other hand impells double links AC . . . CA and DB . . . BD.

These links are necessarily constituted by either two groups of three protrusions of the type ACA and BDB or a group of three protrusions+two groups of two protrusions of the type ACA and BD . . . DB or four groups of two protrusions of the type AC . . . CA and BD . . . DB for each half-series.

The symmetrical groups of two or three protrusions can be separated from each other only by an even number of protrusions (0 or 2) due to the fact that ACXBD, where X is A, B, C or D, conduces to situations which exist already, i.e. CA, BD or which have no interest, being of the type CC or BB.

Consequently, a protrusion of separation is impossible.

ACXYZBD, where X, Y, Z are A B, C or D, conduces to a similar situation with three separating protrusions, since X can be neither A, nor C, nor Z, can be neither B, nor D, nor Y and can be only on the one hand A or C or on the other hand B or D, that is impossible.

Figure 7:
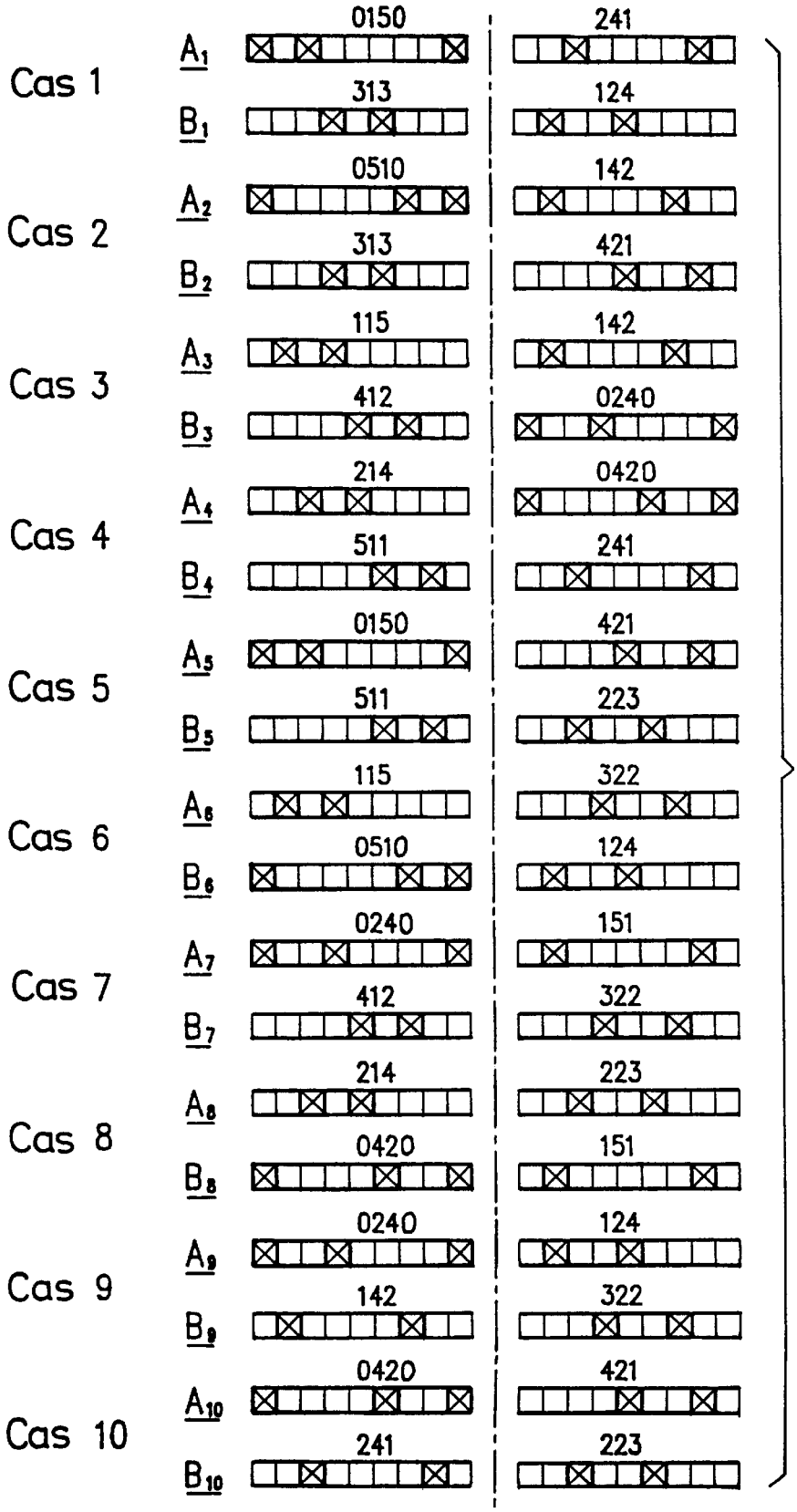
FIG. 7 is a diagrammatic representation of the series of the protrusions and of the free spaces of ten cases of four plates able to be articulated two by two, among which case 7 corresponds to the embodiment of FIGS. 1 to 6.

This conduces to the ten following cases, illustrated in FIG. 7, in which the series of the intervals has been indicated, as in FIG. 2, by data:

| | | |
|---|---|---|
| Case 1 | A C A D B D C B A | C D A B D B C A C |

It is to be noted that, in this table, the letters in the squares correspond to protrusions and that the links between the protrusions belonging to symmetrical plates have been indicated in big characters.

One can also consider a representation under the shape of a binary table, as indicated hereunder for only the case 1, where the data "1" expresses the presence of a protrusion and the data "0"a free space. Such binary representation facilitates a mathematic or informatic treatment.

| | | |
|---|---|---|
| A | 1 0 1 0 0 0 0 0 1 | 0 0 1 0 0 0 0 1 0 |
| C | 0 1 0 0 0 0 1 0 0 | 1 0 0 0 0 0 1 0 1 |
| B | 0 0 0 0 1 0 0 1 0 | 0 0 0 1 0 1 0 0 0 |
| D | 0 0 0 1 0 1 0 0 0 | 0 1 0 0 1 0 0 0 0 |

In the cases 2, 3 and 4 hereafter indicated under the shape of tables, the missing links DC, BC, AB are realized at the left side and at the right side of the block ACADBD.

| | | |
|---|---|---|
| Case 2 | D C B A C A D B D | B D B C A C D A B |
| Case 3 | B A C A D B D C B | D A B D B C A C D |
| Case 4 | C B A C A D B D C | A B D B C A C D A |

Concerning the two following cases (cases 5 and 6), it is to be noted that one can separate the two groups ACA and DBD only by two letters, and not by only one. As a matter of fact, while separating these two groups by only one letter X one would obtain ACA X DBD. Now, X=A or B or C or D, so that one would constitute AA or BD, BD or AC, AC or DD, all these links being without interest.

The same way, there is no interest to introduce three protrusions X, Y, Z between two groups, that would conduce to a situation similar to this one where one would introduce a protrusion X only.

| | | |
|---|---|---|
| Case 5 | A C A B C D B D A | C B D B A D C A C |
| Case 6 | D A C A B C D B D | B D B A D C A C B |
| Case 7 | C A B C D B D A C | A C B D B A D C A |

This case corresponds to the embodiment of FIGS. 1 to 6.

In the present case, the half-series is obtained from the half-series of the case 5 while moving merely the link AC from the extreme left side to the extreme right side.

| | | |
|---|---|---|
| Case 8 | B D A C A B C D B | D B A D C A C B D |

The half-series of this case is obtained from the half-series of case 6 while displacing merely the link BD of the extreme right side to the extreme left side.

One could also consider that the groups ACA and BDB are separated for constituting AC . . . CA and DB . . . BD. There are then two ways of placing them which constitute the cases 9 and 10.

| | | |
|---|---|---|
| Case 9 | C D B C A B D A C | A C B D C A D B A |
| Case 10 | A C D B C A B D A | C B D C A D B A C |

The half-series of case 10 is obtained from the half-series of case 9 while displacing the ninth protrusion, which is "isolated" from the extreme left side to the extreme right side.

It is to be noted that it is not possible to intercalate this ninth protrusion between the four groups of two symmetrical protrusions, since one then would have either a repetition of protrusions or a repetition of groups of two symmetrical protrusions.

Formally, it it always possible to permute the names of the protrusions. For instance A with C or B with D, or even AC with BD, since it is matter of arbitrarily designating the plates and the series of protrusions with which they are provided; physically, this does not constitute modifications.

These ten cases have been illustrated diagrammatically in FIG. 7 which is similar to FIG. 2 of the first embodiment. In this figure, the designations A and B of the plates have been provided with a numbered index corresponding to the case of which it is matter.

Incidentally, case 7 of FIG. 7 corresponds to the first embodiment (FIG. 2).

In the ten cases of FIG. 7, one sees that two series of protrusions are sufficient in each case, the two other series being superposable by turning over.

Five protrusions in one of the series or four in the other one are necessary. Consequently, the eighteen positions are all occupied.

The analysis of the intervals on each of the ten cases shows that the sum of the intervals of the two series is worth 27 units. This data of 27 is constituted by 3×7+1×6 while considering the half-series. In the case 1, for instance, the sum of the intervals of the half-series at the left side of A is of six positions and this one of the half-series at the right side of seven positions, while the sum of the intervals of the half-series at the left side of B is of seven positions as well as this one of the right side.

One finds, in each of these ten cases, a series which starts with an end protrusion.

In none of the series or half-series there are adjacent protrusions so that there is no "0" in a half-series.

When the protrusions are in the number of three and when two of them are situated at the ends of the half-series, the sum of the intervals of the half-series is worth six positions. Hence, the interval which is the longer is of five positions.

It is not possible that there are two intervals of three units which are adjacent, either 331, either 133, either 033. This would necessitate unavoidable double links so that other ones would fail, necessarily, that excludes these cases. On the other hand, the half-series "313" is possible (see cases 1 and 2 of FIG. 7).

One ascertains that, in these ten cases:

only one space is worth 0 two to four spaces are worth 1 two to five spaces are worth 2 from zero to two spaces are worth 3 one to three spaces are worth 4 from 0 to two spaces are worth 5

In other words, there is always one space worth 0, at least two spaces worth 1, at least two spaces worth 2, at least one space worth 4 and at least one space worth 3 or 5.

The choice from one or the other of cases 1 to 10 hereabove mentioned can depend from the resistance of the assembling or from the mechanical torque necessary to separate two plates.

One will speak from torque when the separation of the plates from each other will be effected by torsion around an axis which is perpendicular to the plane of the two assembled plates disposed, for the operation, in the prolongation from another. The evaluation of the resistance to the torsion can be effected while considering cases 1 to 10 hereabove mentioned.

If one admits a pulling out force f which is constant for each pair of protrusions engaging with each other, the torsion torque or moment M necessary for separating two assembled plates calculated with respect to the median axis 4 will be the following $$|M_{xy}| = f \cdot d_{xy} + f \cdot d_{yx}$$

$d_{xy}$ being the distance between the axis 4 and any connection, generally called XY.

Obviously, if there is a double connection, the moment M is the sum of both.

The maximum difference between the extreme torques, the average torque and the minimum torque has been indicated in front of each table of cases 1 to 10 taken from FIG. 7. The detail of the calculation of the torques has been indicated for the case 7 due to the fact that it constitutes the most favourable case.

Case 1

| | |
|---|---|
| ACADBDCAB | CDABDBCAC |

Maximum difference 26f, average torque 12f, minimum torque 4:

Case 2

| | |
|---|---|
| DCBACADBD | BDBCACDAB |

Maximum difference 12f, average torque 12f, minimum torque 6:

Case 3

| | |
|---|---|
| BACADBDCB | DABDBCACD |

Maximum difference 20f, average torque 12f, minimum torque 6:

Case 4

| | |
|---|---|
| CBACADBDC | ABDBCACDA |

Maximum difference 14f, average torque 12f, minimum torque 8:

Case 5

| | |
|---|---|
| ACABCDBDA | CBDBADCAC |

Maximum difference 24f, average torque 12f, minimum torque 6:

Case 6

| | |
|---|---|
| DACABCDBD | BDBADCACB |

Maximum difference 20f, average torque 12f, minimum torque 6:

Case 7

| | |
|---|---|
| CABCDBDAC | ACBDBADCA |

Maximum difference 10f, average torque 12f, minimum torque 8f $M_{AC} = f * (8 + 1 + 1 + 8) = f * 18$
$M_{BD} = f * (3 + 4 + 4 + 3) = f * 14$
$M_{AB} = f * (7 + 5) = f * 12$
$M_{AD} = f * (2 + 6) = f * 8$
$M_{CD} = f * (5 + 7) = f * 12$
$M_{BC} = f * (6 + 2) = f * 8$ -continued Case 8

| | |
|---|---|
| BDACABCDB | DBADCACBD |

Maximum difference 16f, average torque 12f, minimum torque 6:

Case 9

| | |
|---|---|
| CDBCABDAC | ACBDCADBA |

Maximum difference 12f, average torque 12f, minimum torque 8:

Case 9

| | |
|---|---|
| ACDBCABDA | CBDCADBAC |

Maximum difference 18f, average torque 12f, minimum torque 6:

One sees that it is case 7 which is the most favourable from the mechanical point of view, since it is the one in which the difference between the extreme torques is the lowest (10f) and almost this one for which the minimum torque is the highest (8f). However, case 4 shows also a minimum torque of 8f that renders it almost as favourable as case 7. It is the same for case 9 where the minimum torque is also of 8f, the only difference lying in a maximum difference of 12f instead of 10f for case 7.

Figure 8:
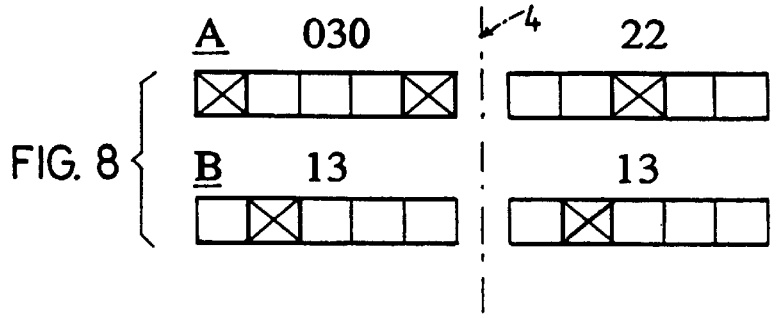
FIG. 8 shows diagrammatically two shorter series of protrusions permitting any articulation three by three of four plates.

FIG. 8 illustrates the case of four plates two of which, indicated by A and B, are symmetrical from the two other ones, respectively, and which can be assembled three by three. One of the rectilinear edges of these four plates is provided with a series of protrusions, each of ten positions, each divided in two half-series, situated at the left side and at the right side of a median axis 4. FIG. 8 shows that the half-series at the left side of plate A comprises two end protrusions separated by a free space of three units, and that the half-series at the right side shows a protrusion situated in the middle, situated between two free spaces each of two units. So far as the half-series of plate B is concerned, it shows a protrusion situated at a distance of one unit from one end of the half-series and of three units from the other end. It is the same for the half-series at the right side of plate B.

It is to be noted that the notation 13,13 of FIG. 8 could suggest that there is a symmetry. However, it is not the case since, if one turns the plate over with respect to its median point, one sees that the protrusions are then placed at different places.

Figure 9:
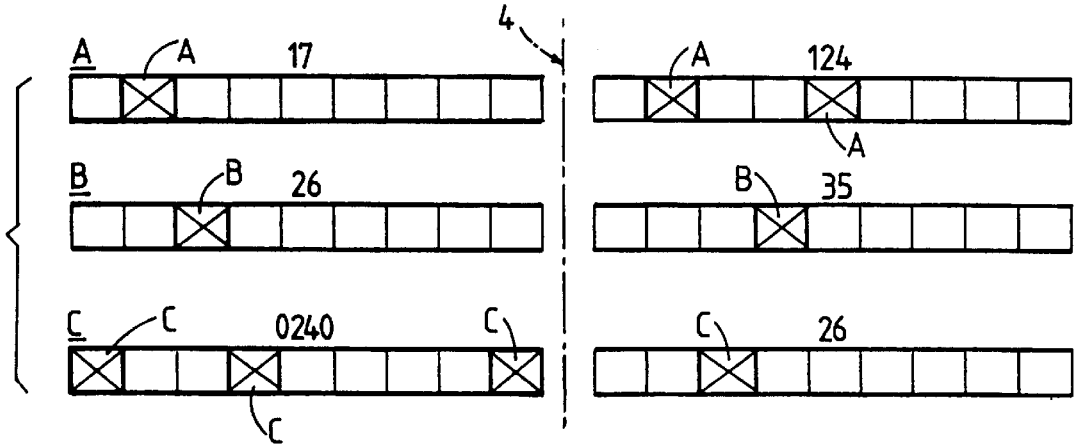
FIG. 9 shows diagrammatically three series of protrusions permitting eight articulations two by two of six plates, among the fifteen of which which are theoretically possible, but with much more positions.

FIG. 9 shows the series of the protrusions of three plates A, B and C, having eighteen positions, being understood that the set will comprise three other plates symmetrical with respect to plates A, B and C, respectively. This set will permit eight assemblings or hanges which are possible, among the fifteen assemblings two by two which could be theoretically possible, but with more positions.

Figure 10:
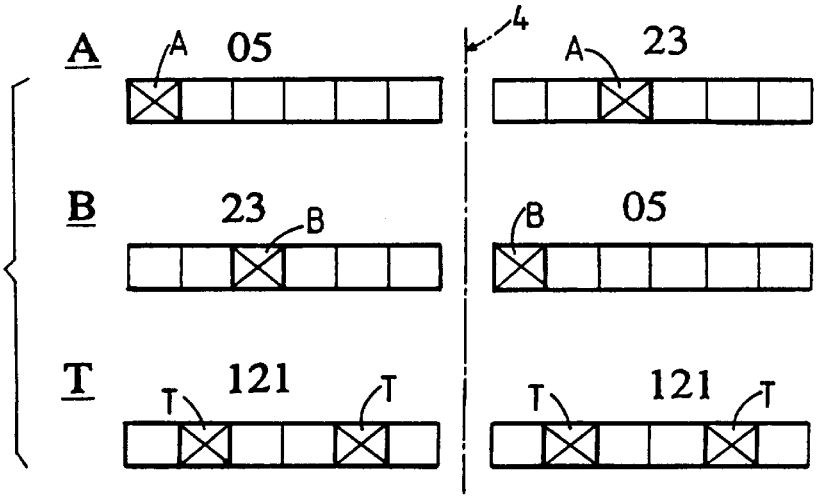
FIG. 10 is a diagrammatic representation of a series of protrusions of a modification.

FIG. 10 illustrates diagrammatically the case of a set of four plates having twelve positions, in which two of these plates A and B are symmetrical with respect to the two other ones, respectively. The two half-series of protrusions A of plate A are expressed by 05 and 23 and the ones B of plate B by 23 and 05. An auxiliary plate T the half-series of protrusions T of which, which are expressed by 121, are identical and symmetrical, permits, in combination with the four plates of the set, a number of four assemblings A, B, C, D with T, consequently of any assembling of the plates A, B, C and D two by two, with the plate T.

Figure 11:
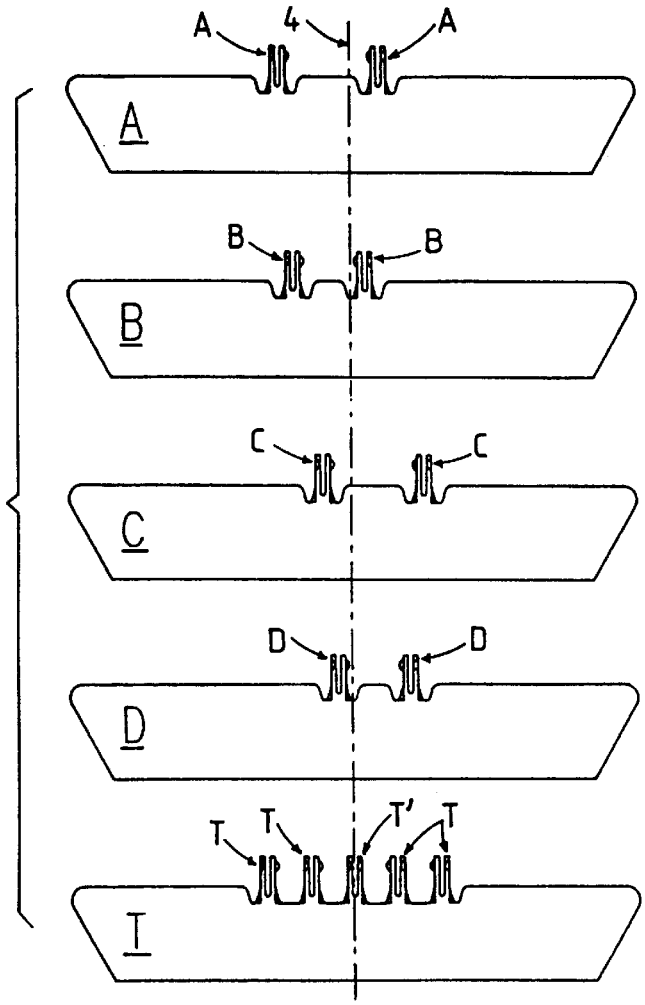
FIG. 11 shows a set of five plates able to be articulated to each other.
Figure 12:
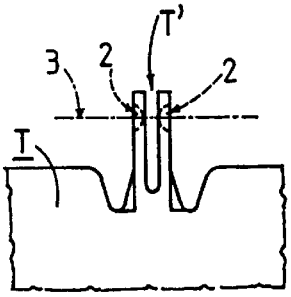
FIG. 12 is a plan view to an enlarged scale of a detail of FIG. 11.
Figure 13:
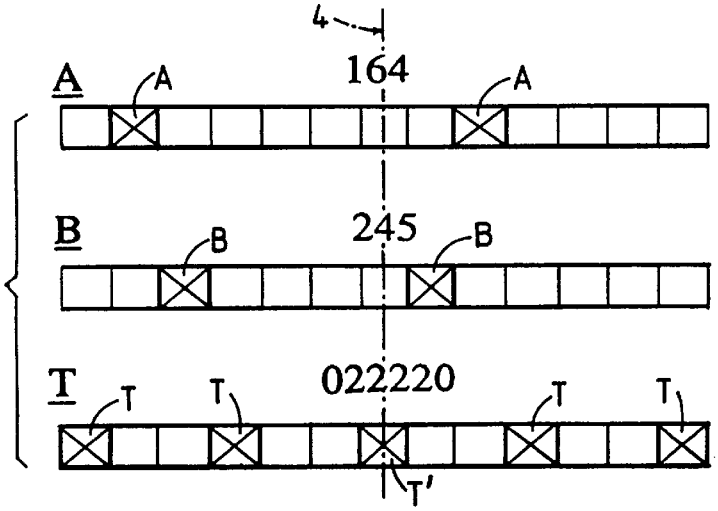
FIG. 13 is a diagrammatic representation of the series of protrusions of three of the five plates of FIG. 11.

So far as FIGS. 11 to 13 are concerned, they illustrate still another case of a set of four plates A, B, C or D, of thirteen positions, the plates C and D of which are symmetrical with respect to plates A and B, respectively, to which is added an auxiliary plate T. The latter is provided with two half-series of protrusions T situated on both sides on the median axis 4 and moreover with a central protrusion T', represented to an enlarged scale in FIG. 11, situated on this axis, which distinguishes from the other protrusions by the fact that its resilient branches do not show a recess and an embossment, as in all the preceeding cases, but with two recesses 2. The whole series of protrusions of plate T can be expressed by 022220 as indicated by FIG. 13. Consequently, this auxiliary plate is the only one which is symmetrical and the following assemblings are possible: AT, BT, CT, DT, AB, CD and consequently also any assembling of two plates A, B, C and D two by two, with plate T.

Figure 14:
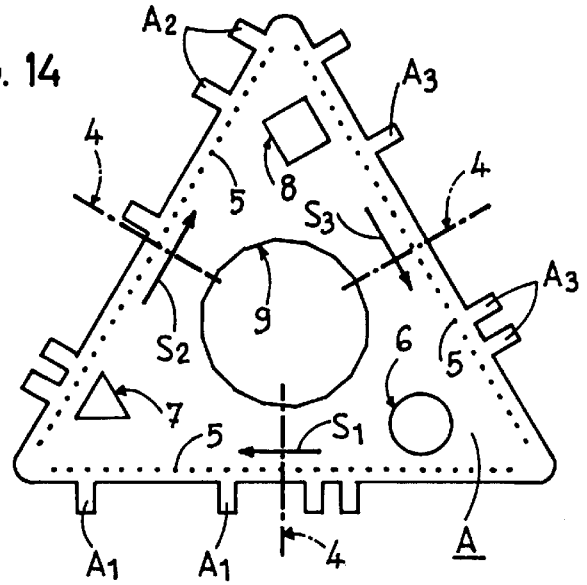
FIG. 14 shows a plate made of an equilateral triangle belonging to a set of identical plates.

The plate represented in FIG. 14, designated by A, belongs to a set of identical plates. It is constituted by an equilateral triangle the three edges of which are provided with series of protrusions of twenty-six positions indicated by points 5, these series being represented symbolically by three arrows $S_1$, $S_2$ and $S_3$, the protrusions of these three series, represented diagrammatically, being designated by $A_1$, $A_2$ and $A_3$, respectively. The middle point of these three series is indicated by an axis 4 for each of them. Plate A is provided with three holes 6, 7 and 8, of different shapes, permitting to identify these series, whatever may be the face of the plate which is observed.

Plate A is intended to be used either in the position represented in FIG. 14, or turned over on itself, recto-verso.

Figure 15:
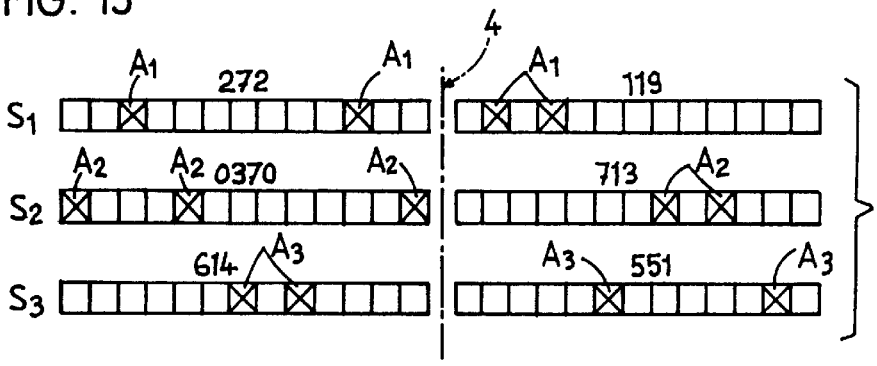
FIG. 15 is a diagrammatic representation of the series of the protrusions and of the free spaces of the three edges of the triangular plate represented in FIG. 14.

The three half-series of the series of protrusions $S_1$, $S_2$ and $S_3$ are represented diagrammatically in FIG. 15 and are expressed, as previously, by data, i.e. 272 for the first half-series of $S_1$, 119 for the second one, 0370 for the first half-series of $S_2$, 713 for the second one, 614 for the first half-series of $S_3$, 551 for the second one.

Figure 16:
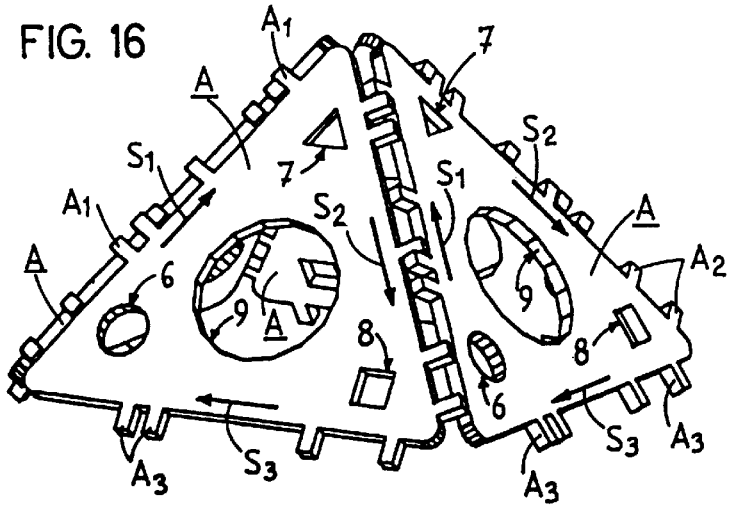
FIG. 16 is a perspective view of a pyramid having a square base constituted of four plates such as the one represented in FIG. 14.
Figure 17:
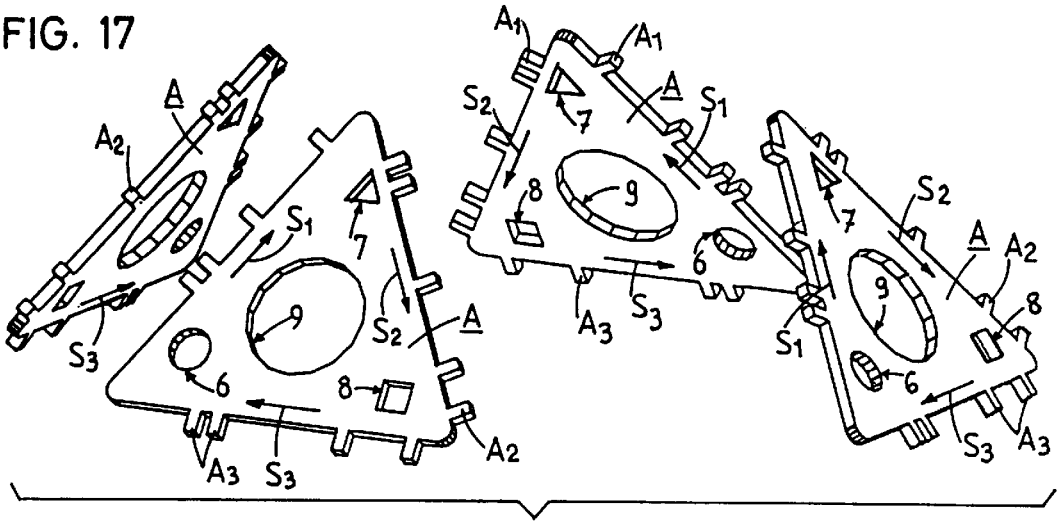
FIG. 17 is an exploded view of this pyramid, to an enlarged scale.
Figure 18:
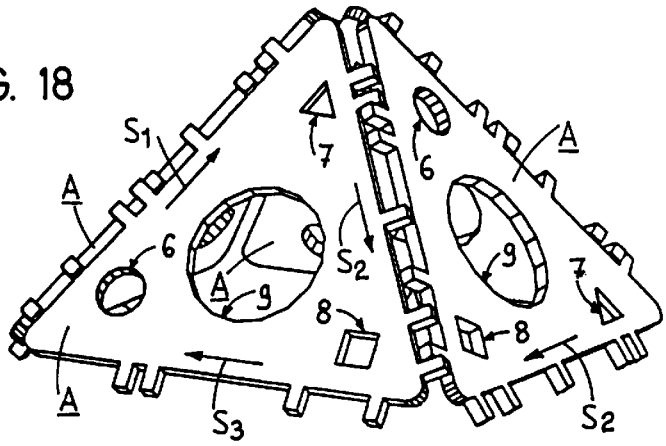
FIG. 18 is a perspective view of a pyramid having a square base constituted of four plates such the one represented in FIG. 14, but arranged in a way which is different from this of FIG. 16.

A set of triangular plates A as this one represented in FIG. 14 can be used for the realization of a pyramid having a square base such as this one represented in FIG. 16 or this one of FIG. 18.

In the case of FIG. 16, the four triangular plates A constituting the pyramid, the base of which is not concretized but which could be by a square plate, have all a same face turned to the outside or to the inside, that is to say that none of them is turned over recto-verso. Moreover, they are all oriented the same way, the edge of each plate constituting the base being constituted by the series $S_3$.

Figure 19:
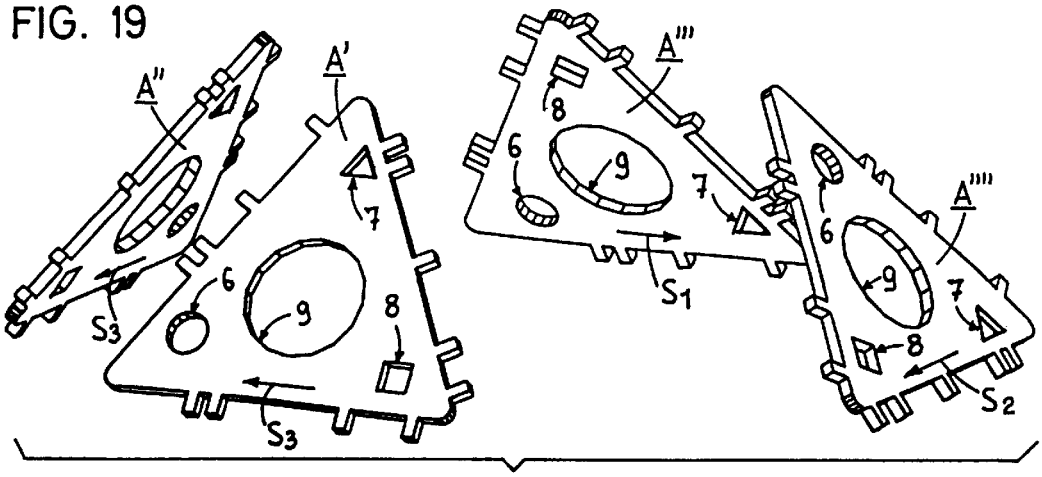
FIG. 19 is an exploded view of this pyramid, to an enlarged scale.

In the case of the pyramid of FIG. 18, on the contrary, plates A are all used turned the same way but in different orientations. Thus, the basis edge of the pyramid is constituted by the series $S_3$ so far as the front plate, designated by A' is concerned, also by $S_3$ so far as the left side plate of FIG. 19, designated by A", is concerned, by $S_1$ for the rear plate, designated by A'", and by $S_2$ for the right side plate of FIG. 19, designated by A"".

Figure 20:
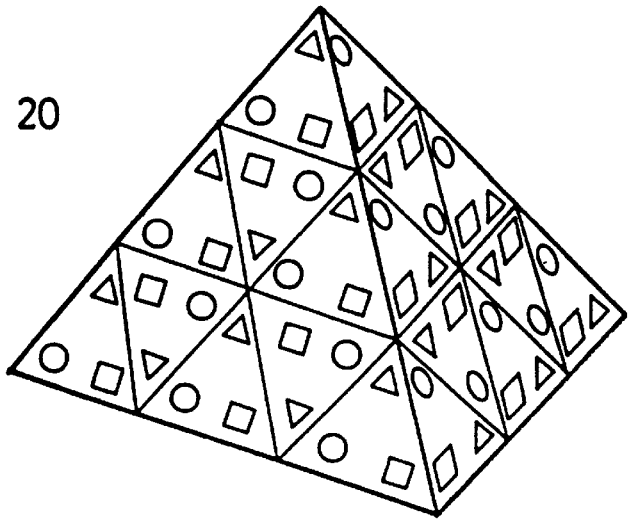
FIG. 20 is a perspective view of a pyramid constituted by a whole of pyramids such as the one represented in FIG. 18, to a smaller scale than this of FIGS. 16 and 18.
Figure 21:
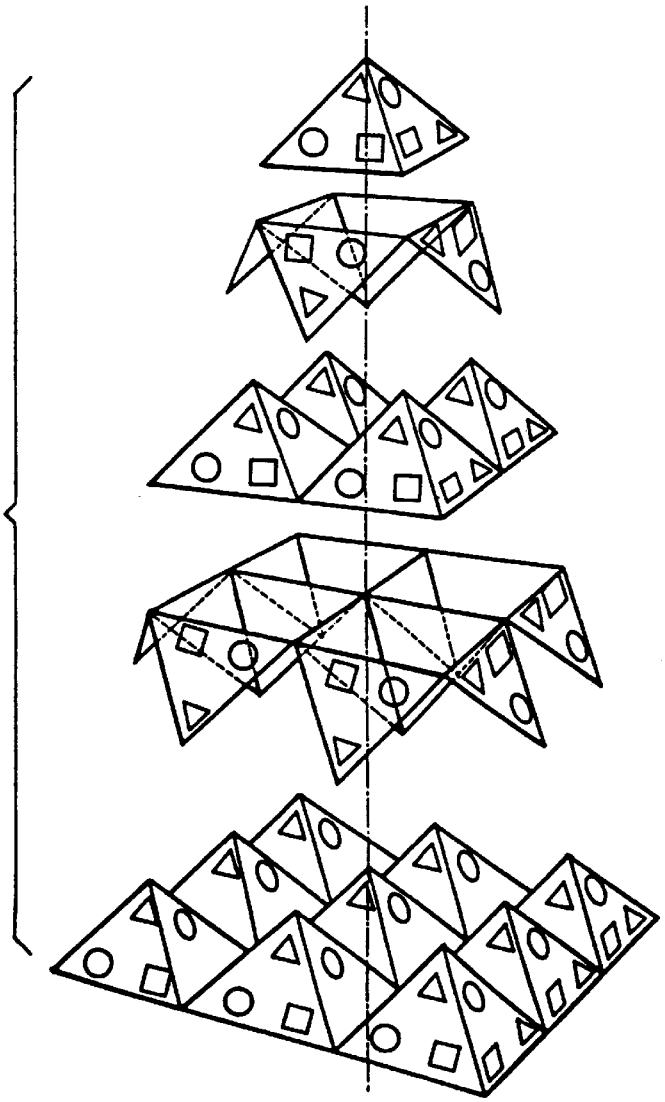
FIG. 21 is an exploded view of the pyramid of FIG. 20.

One could, still by means of plates identical to plate A of FIG. 14, realize not only pyramids of the type of these of FIGS. 16 or 18, but also pyramids having multiple layers, such as this one of FIGS. 20 and 21 in which the central hole 9 of the plates has not been represented.

FIG. 21 is specially representative of the way the pyramid of FIG. 20 is made. This pyramid is constituted by successive layers; the first one, from the top, is constituted by a pyramid like pyramid of FIG. 18, the third one by four identical pyramids which are juxtaposed and the fifth one by nine identical pyramids which are juxtaposed.

So far as the even layers are concerned, they are constituted by identical pyramids but turned over, one for the second layer and four for the fourth layer and, moreover, by complementary triangular plates A constituting closing shutters.

The number of layers, always uneven, could be higher than five, which is the case of the example disclosed and represented.

One realizes this way, innerly walled pyramids which could, if the triangular plates A are provided with patterns, constitute a tridimensional puzzle. The same way, if the plates A are provided with a central hole such as the hole designated by reference 9 in FIG. 14, also represented in FIGS. 16 to 19, the plates A could serve to the realization of innerly walled solids permitting to play a game consisting in passing members through the holes of the inner walls of the solid or to secure a member provided with a special pattern, for instance a graphic symbol, a data or a letter (removable in this case, but which could also be printed directly on the plate).

Figure 22:
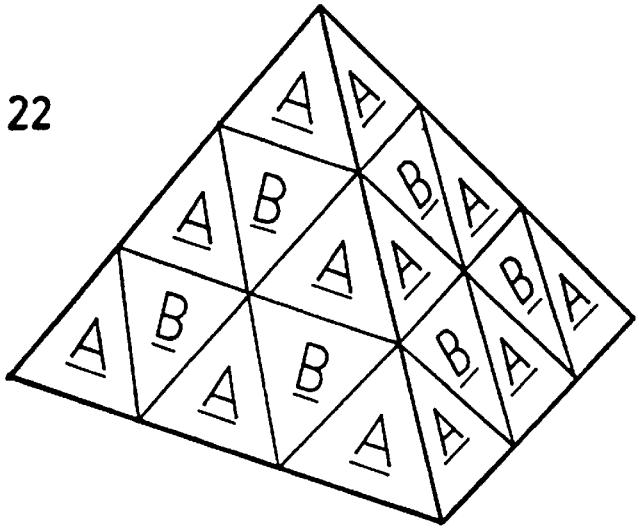
FIGS. 22 and 23 are views similar to the ones of FIGS. 20 and 21, respectively, of a modification of a pyramid.
Figure 23:
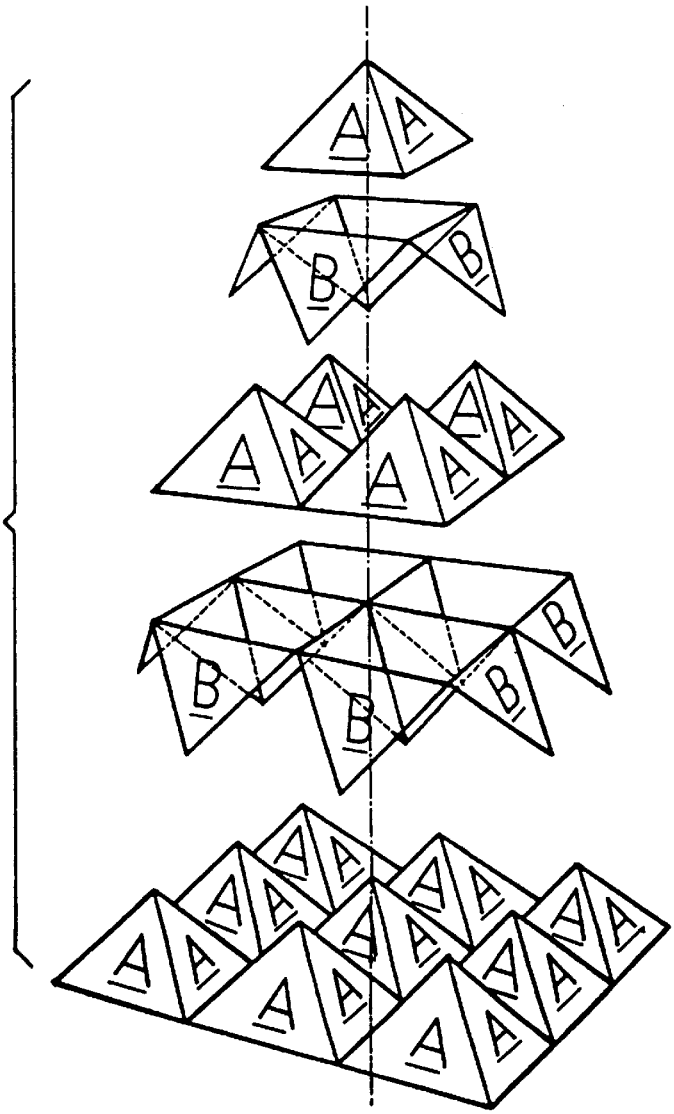

One could realize pyramids which are similar to the one represented in FIGS. 16 and 18, such as the pyramid of FIGS. 22 and 23, while using plates A and B of two different types, having the shape of equilateral triangles. The plates of the two types will present, on their three sides, series of identical protrusions, but different for each of the said two types.

It is to be noted that multi-layers tetrahedrons can be realized the same way as the pyramids, so far as they are cut along planes the angle of which is choosen in such a way that one finds the same conditions as these of the pyramid.

Generally speaking, pavements at two dimensions, plan or in relief, also polyhedrons, can be realized with polygons provided with only one series A or with only a series B. These pavements realize interengagements of the type AC or respectively BD, that is to say between the series A and the series A turned over, i.e. C, since the opposed sides of a polygon, if they are faced to each other, are turned over.

Obviously, a pavement of the type AC can be connected, on an open or closed periphery, by its articulations, to a pavement of the type BD. That needs that the walled structures can be realized by alternating the layers AC and BD. A pyramid can for instance be thus realized by using the two types of triangles showing, on their respective peripheries, both three identical series but different from each of these two triangles.

Figure 24:
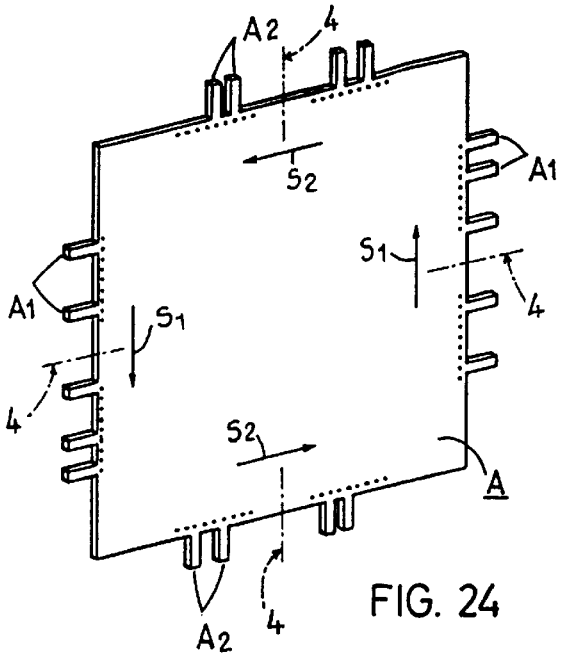
FIG. 24 is a perspective view of a square plate belonging to a set of identical plates the series of protrusions of which are the same as the ones of the embodiment of FIGS. 1 to 6.

Different series on the periphery of the same polygon have already been considered (FIG. 14) but will appear also later (FIG. 24).

By means of the distribution of different series along the periphery of a polygon, it is possible to make choices conducing to a reduction of the number of the necessary positions, especially when these polygons serve to the realization of walled structures. Especially, as indicated hereabove, an interesting solution can be realized with twenty-six positions (see FIGS. 14 to 21); in this case, all the articulations two by two are not necessary, since they do not appear during the realization of the construction.

Generally speaking, if the number of the positions of twenty-six for a triangular plate is convenient, especially for mounting walled pyramids, this number could be different, being situated between eighteen and thirty-eight, depending if one is satisfied with a minimum number of two connected edges, or on the contrary if one requires that all the edges be connected two by two, with or without a turning over of plates.

The plate represented in FIG. 24, designated by A, belongs to a set of identical plates. It is constituted by a square the four edges of which are provided with series $S_1$ and $S_2$ of protrusions, of eighteen positions. These protrusions, diagrammatically represented, are designated by $A_1$ and $A_2$ depending from the series to which they belong. The series of two opposite sides, represented diagrammatically by the arrows $S_1$ and $S_2$, are identical to these of the plates A and B of FIG. 1. They are symmetrical with respect to the axes of the square indicated at 4. When using the same notation as previously where the number of the positions of the free spaces separating the protrusions is numbered, one ascertains that the half-series at the left side of the series $S_1$ is expressed by 0240, the half-series of the right side by 151, the half-series at the left side of the series $S_2$ by 412 and the half-series at the right side by 322.

Figure 25:
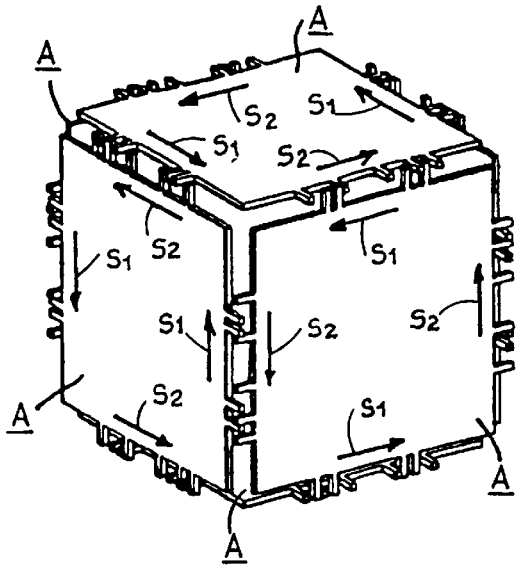
FIG. 25 is a perspective view of a cube constituted of six plates such as the one represented in FIG. 24.
Figure 26:
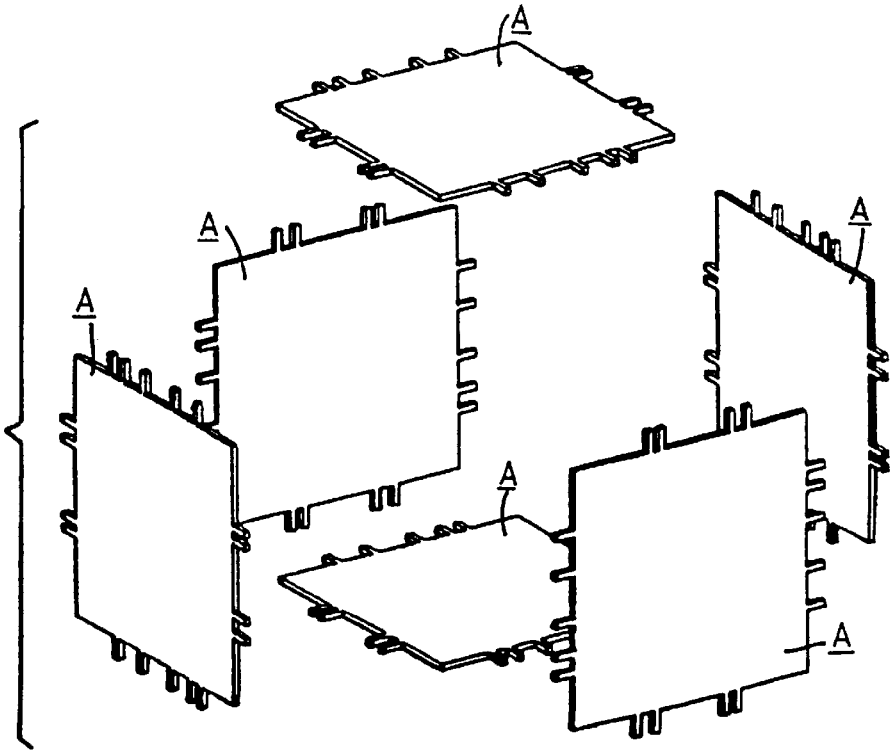
FIG. 26 is an exploded view of this cube.

By means of six of these plates A, it is possible to realize a cube such as this one represented in FIGS. 25 and 26.

Figure 27:
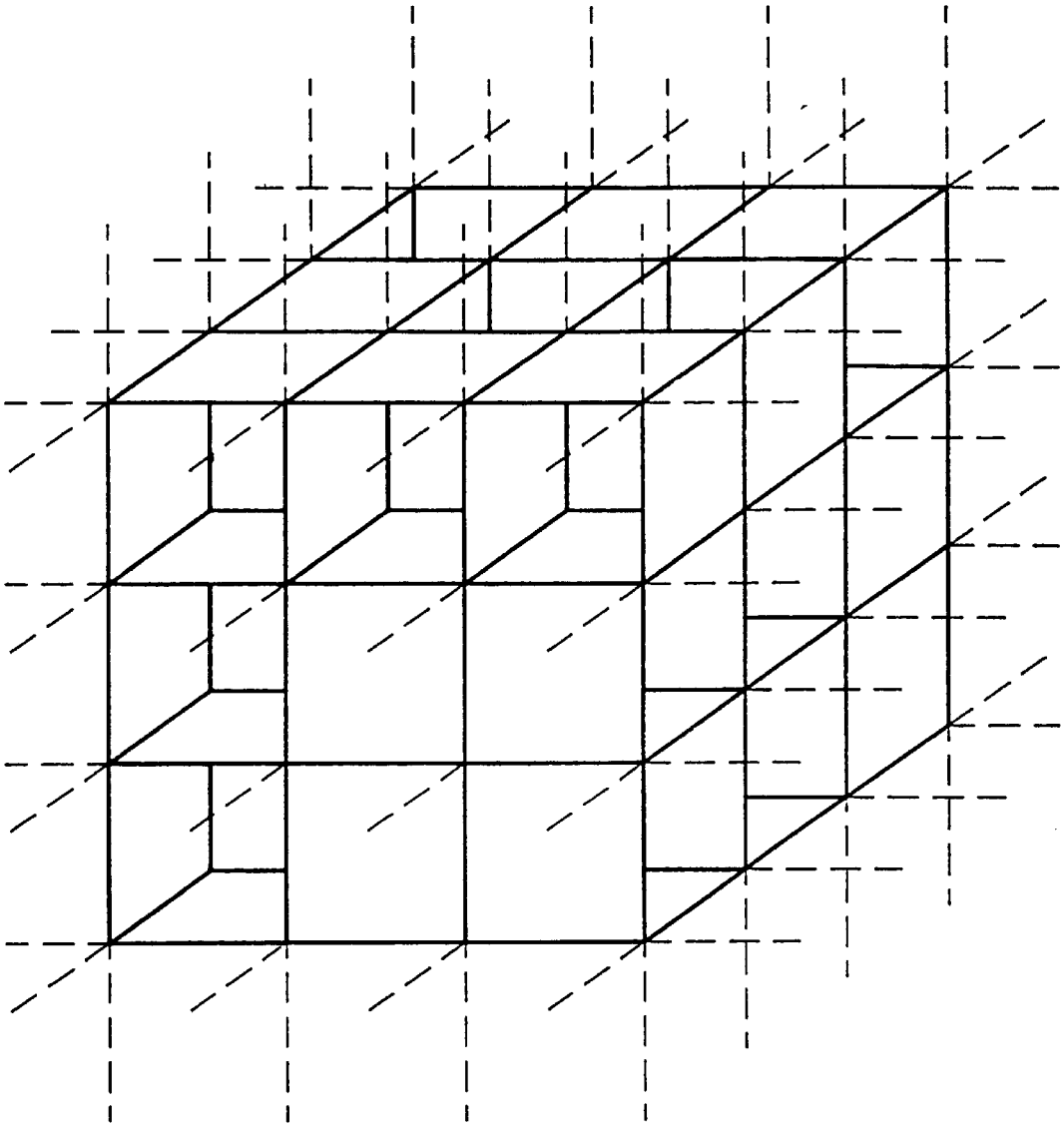
FIG. 27 is a perspective view of a portion of a cubic net constituted by identical square plates such the one of FIG. 24.

One can repeat the assembling of these plates A in such a way as to form a walled net of cubic cells, as represented in FIG. 27.

Figure 28:
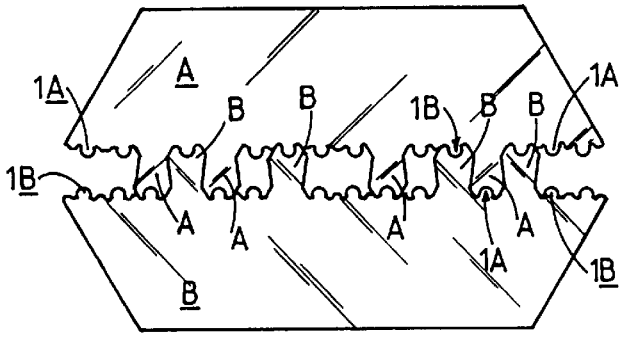
FIG. 28 shows, in a similar way as FIG. 3, two plates articulated to each other, the protrusions of articulation being however different from these of the several preceeding examples.

In all the cases which have been disclosed and represented hereabove, the protrusions for the assembling or interengagement of the plates are slot longitudinally so as to constitute two resilient branches. In the embodiments which are disclosed hereafter, these protrusions are different and are not slot. They show a periphery which is symmetrical with respect to their longitudinal axis. Their end is enlarged and their basis is narrowed. The plates are made of resiliently deformable material so that, by deformation of this material, the interengagement of the protrusions with each other can be effected. Thus, in FIG. 28 have been represented two plates A and B provided, respectively, with protrusions A and B.

This arrangement has the advantage, with respect to this of the examples which have been previously disclosed and represented, of permitting the realization of joined or contiguous series and to permit, consequently, to reduce the number of the positions which are necessary, as well as the total width occupied by two series.

Figure 30:
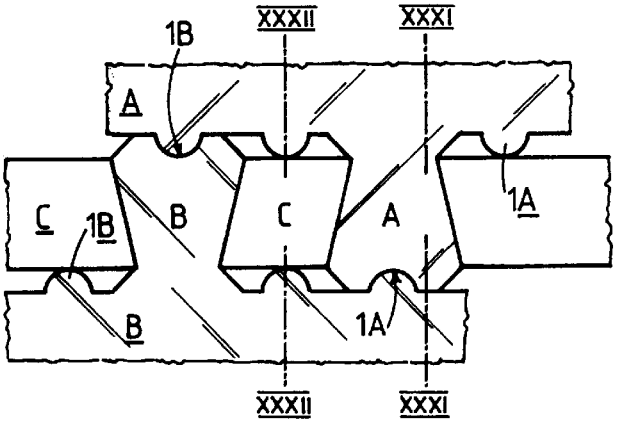
FIG. 30 shows the assembling of three plates to each other by means of protrusions of the same type as these of FIGS. 28 and 29.

Physically, the two plates A and B are identical, but represented in the drawing turned over recto-verso one with respect to each other. Consequently, they are symmetrical one with respect to each other. At each position the rectilinear edge of the plates which are provided with the protrusions show small embossments which are half-cylindrical, designated by 1A for the plate A and by 1B for the plate B. So far as the protrusions A and B are concerned, they are provided, on their front face, each with a recess 1A for the protrusions A and 1B for the protrusions B, the embossments 1A and 1B engaging the recesses 1B and 1A, respectively, that improves the rigidity of the assembling. Moreover, when more than two plates are assembled to each other, as shown for instance by FIG. 30, these embossments 1A and 1B produce the centering of the intermediary plate C.

Figure 29:
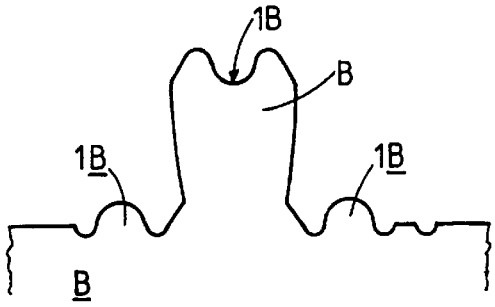
FIG. 29 is a view of a detail of FIG. 28 to an enlarged scale.

In these several embodiments, the plates can intermesh while making between each other angles different from 90°. It is the case, for example, when the plates constitute the faces of a regular pyramid or of a regular tetrahedron where they will then make angles of 109,47°and 70,53°, respectively. It is important, to this effect, that the length of the protrusions be 40% higher than their width, this width being equal to the thickness of the plate, for taking the angle into account. The profile of FIG. 29 permits as well to center plates which are perpendicular to each other as to incline them with respect to each other.

Figure 31:
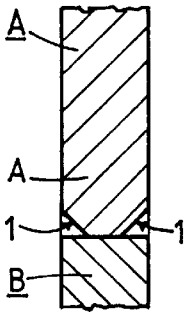
FIG. 31 is a sectional view on the line XXXI—XXXI of FIG. 30.
Figure 32:
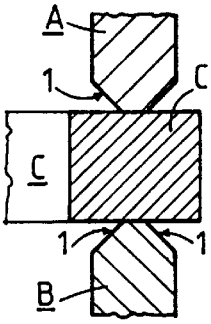
FIG. 32 is a sectional view on the line XXXII—XXXII of FIG. 30.

It is to be noted that bevelled edges 1 (FIGS. 31 and 32) have been provided on the plates so as to facilitate their interengagement.

Figure 33:
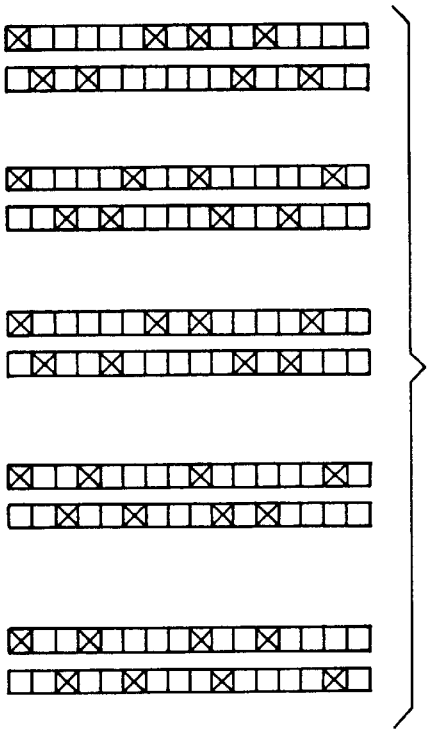
FIG. 33 is a diagrammatic representation, similar to this of FIG. 9, for instance, of the series of protrusions and of free spaces, in which the protrusions have the shape of these of FIGS. 28 to 32, applied to five cases of four plates able to be articulated two by two.

FIG. 33 shows the series of protrusions which are possible for sixteen positions permitting the intermeshing of four plates two by two, the protrusions having the shape of these of FIGS. 28 to 32.

The analysis of the mechanical torques gives the following results:

Case 1 (16)

| | |
|---|---|
| ABDBCDAC | ACBADBDC |

Maximum difference 20f, average torque 9.3f, minimum torque 2

Case 2 (16)

| | |
|---|---|
| ACBDBADC | ABCDBDAC |

Maximum difference 14f, average torque 9.3f, minimum torque 4

Case 3 (16)

| | |
|---|---|
| ABCDBDAC | ACBDBADC |

Maximum difference 12f, average torque 9.3f, minimum torque 2

Case 4 (16)

| | |
|---|---|
| ACBADBDC | ABDBCDAC |

Maximum difference 8f, average torque 9.3f, minimum torque 6f

Case 5 (16)

| | |
|---|---|
| ADBACBDC | ABDACDBC |

Maximum difference 10f, average torque 9.3f, minimum torque 6

One sees that it is case 4 which is the most favourable from the mechanical point of view, since it is the one of which the deviation between the extreme torques is the lowest (8f) and this one for which the minimum torque is the highest (6f). However, case 5 is alsmost as favourable, the only one difference lying in the maximum deviation which is of 10f instead of 8f.

Figure 34:
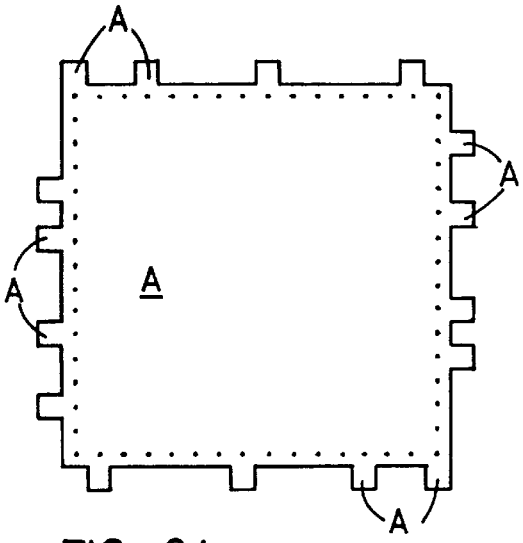
FIGS. 34 and 35 show two square plates, the first one having sixteen positions and the second one fifteen, in which the protrusions, which are diagrammatically represented, have the shape of the ones of FIGS. 28 to 32, permitting the realization of solids by interengagement of identical plates.

FIG. 34 illustrates a square plate A the four edges of which are of sixteen positions each, the protrusions, designated by A, being represented diagrammatically while they correspond, so far as their shape is concerned, to these of FIGS. 28 to 32. The four series of these sixteen positions square are disymmetrical.

Figure 35:
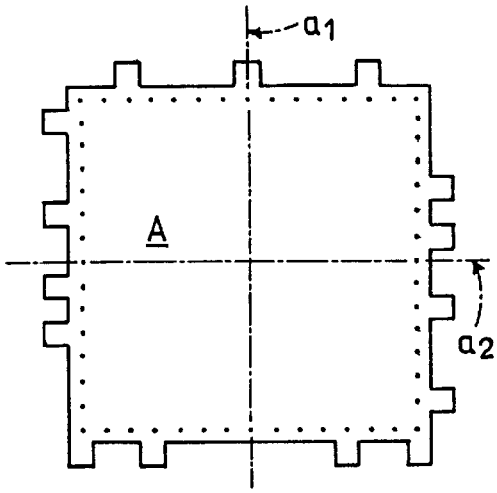

On the contrary, in the case of the square plate A of FIG. 35, the edges of which have fifteen positions each, the series constituted by these fifteen positions are, for two of them which are opposite to each other, symmetrical with respect to the axis $a_1$ of the square while the two other ones, which are opposite to each other, are disymmetrical with respect to the axis $a_2$ of the square. However, the two series which are disymmetrical with respect to the axis $a_2$ are identical if one considers the plate viewed recto and verso.

As a modification, one could provide the case where the two symmetrical series would be of sixteen positions, provided the central protrusion of the upper edge of the plate of FIG. 35 has a double width and occupies then two positions, i.e. the positions "8" and "9".

Figure 36:
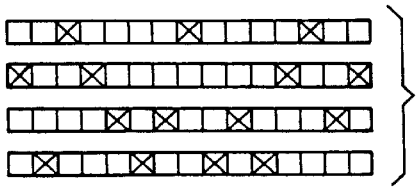
FIG. 36 is a diagrammatic representation, similar to this of FIG. 33, of a set of four plates able to be articulated two by two.

FIG. 36 is a diagrammatic representation of the series of protrusions and of intervals of the four assembling edges of four plates able to be interengaged two by two, all the four plates being identical to this of FIG. 35. The series of the two first lines of FIG. 36 are symmetrical while these of the two following lines are disymmetrical with respect to the middle of the edge, these two disymmetrical series being identical, the plates being observed recto and verso, respectively.

| | | | | | | | | | | | | | | |
|---|---|---|---|---|---|---|---|---|---|---|---|---|---|---|
| C | D | A | C | B | D | B | A | D | B | D | C | A | B | C |

The analysis shows that the distribution of the mechanical torques is much more homogeneous than for series which would all be symmetrical.

It is to be noted that this configuration is rather favourable from the mechanical point of view since

| | | | |
|---|---|---|---|
| AB | 0.5f + 5.5f | = 6f | |
| AC | 4.5f + 4.5f | = 9f | |
| AD | 0.5f + 5.5f | = 6f | 8f ± 2f |
| BC | 3.5f + 6.5f | = 10f | |
| BD | 1.5f + 2.5f + 2.5f + 1.5f | = 9f | |
| CD | 6.5f + 3.5f | = 10f | |

The maximum difference is of 4f, the average torque of 8.3f and the minimum torque of 6f.

It is to be noted that an assembling of only symmetrical series will give a bad distribution of the mechanical torques. Thus:

| B | A | C | D | B | C | D | A | D | C | B | D | C | A | B |
|---|---|---|---|---|---|---|---|---|---|---|---|---|---|---|

| | | |
|---|---|---|
| AB | 6.5f + 6.5f | = 13f |
| AC | 0.5f + 0.5f | = 11f |
| AD | 0.5f + 0.5f | = 1f |
| BC | 2.5f + 2.5f | = 5f |
| BD | 3.5f + 3.5f | = 7f |
| CD | 1.5f + 4.5f + 4.5f + 1.5f | = 12f |

The maximum difference if of 12f, the average torque of 8.3f and the minimum torque of 1f.

The structures according to the invention could be used not only for toys, as the tridimensional puzzles, but also for the realization of scaled models or prefabricated pannels used specially in the architectural field, or even of more important constructions such as showboothes for instance.

It is to be noted that the present invention can be applied to elements the length of the rectilinear assembling edge of which is higher than the length of a series of protrusions and intervals. In other words, the length of the series is independent from the length of their supports.

In the case of elements the rectilinear edge provided with the assembling protrusions is longer than the length of a series, one can either provide an axis of symmetry in the middle of this long edge with, on both sides, a repetition of half series, or on the contrary provide a repetition of complete series, this second occurrence presenting the advantage of permitting to cut the support of the series in any point of its length.

The supports of protrusions of high length could be either rigid plates or flexible elements, made of textile, for instance, which must show, locally, a rigidity sufficient for permitting that the conditions of interengagement of the protrusions remain satisfied. One could, owing to the present arrangement, carry out the turning over of pieces of texture one with respect to each other in the field of the clothing, or of the furniture or others.

The assembling of such elements could be effected by means of sliding members like these of the sliding fasteners of the type called zip fasteners.

What is claimed is:

1. A set of elements for being interconnected with one another in a mating relationship along rectilinear edges, said set of elements comprising a plurality of separate elements, and each said separate element comprising:

a planar member having at least three rectilinear edges, each one of said at least three rectilinear edges having a plurality of teeth supported therealong, said plurality of teeth being located along each of said at least three rectilinear edges in an asymmetrical arrangement, each of said plurality of teeth having a substantially identical shape to one another and said plurality of teeth being irregularly spaced along each one of the at least three rectilinear edges, and each of said plurality of teeth having a width dimension being measured along the rectilinear edge supporting said plurality of teeth;

a combined width dimension of all of said plurality of teeth, located along each one of said at least three rectilinear edges, being about one quarter of a total length dimension of each one of said three rectilinear edges to facilitate connection of at least four mating elements with one another along each one of said at least three rectilinear edges; and at least two of said plurality of teeth, provided along any one of said at least three rectilineal edges, being utilized for releasable locking engagement with at least two of said plurality of teeth of a mating element, of said set of elements, for lockingly interconnecting two mating elements with one another.

2. The set of elements according to claim 1, wherein each said element of the set of elements is identical to one another and each of said at least three rectilinear edges of each element has a unique arrangement of the teeth compared to the teeth arranged along the rectilinear edges of the other of said at least three rectilinear edges.

3. The set of elements according to claim 1, wherein the plurality of teeth and the spacing between said plurality of teeth are arranged along each said rectilinear edges in a pattern which permits any one of said elements of said set of elements to be assembled with another one of said elements of said set of elements along any one of said rectilinear edges supporting a different pattern therealong.

4. The set of elements according to claim 1, wherein the plurality of teeth each have an identical width dimension, and the width dimension constitutes a unit of measure of a free space separating said plurality of teeth along said rectilinear edges, and each of said rectilinear edges has an arrangement of the free space and said plurality of teeth which is disymmetrical with respect to a central plane bisecting the rectilinear edge.

5. The set of elements according to claim 4, wherein the plurality of teeth and the free spacing intervals are distributed along each rectilinear edge of said plurality of elements in such a way that all the elements are able to be assembled with one another.

6. The set of elements according to claim 4, wherein the said plurality of teeth each comprise two branches separated from one another by a small longitudinal slot so as to form two resilient branches.

7. The set of elements according to claim 1, wherein each said element of said set of elements has a general shape of a square and has four rectilinear edges, and each one of the four rectilinear edges supports four teeth spaced along each rectilinear edge.

8. The set of elements according to claim 1, wherein each said element of said set of elements has a general shape of a triangle and has only three rectilinear edges and each one of said three rectilinear edges supports at least four teeth spaced along each rectilinear edge.

9. A set of elements for being interconnected with one another in a mating relationship, said set of elements comprising at least two separate elements, and each separate element comprising:

a planar member having at least three rectilinear edges, each one of said at least three rectilinear edges having a plurality of teeth located therealong, said plurality of teeth being located along each of said at least three rectilinear edges in an asymmetrical arrangement, and each of said plurality of teeth having a width dimension being measured along the rectilinear edge supporting said plurality of teeth;

a combined width dimension of all of said plurality of teeth, located along each one of said at least three rectilinear edges, being less than one half of a total length dimension of each one of said three rectilineal edges to facilitate connection of at least three mating elements with one another along each one of said at least three rectilineal edges;

the plurality of teeth and the spacing between said plurality of teeth being arranged along each said rectilinear edges in a pattern which permits any one of said elements, of said set of elements, to be assembled with another one of said elements, of said set of elements, along any one of said at least three rectilinear edges supporting a different pattern therealong;

at least two of said plurality of teeth, provided along any one of said at least three rectilinear edges, being utilized for releasable locking engagement with at least two of said plurality of teeth of a mating element, of said set of elements, for lockingly interconnecting two mating elements with one another; and the plurality of teeth and the free spacing intervals being distributed along each rectilinear edge of said plurality of elements so as to allow each of the elements to be assembled with one another.

10. The set of elements according to claim 9, wherein each said element of said set of elements has a general shape of a square and has four rectilinear edges, each of said plurality of teeth has a substantially identical shape to one another and said plurality of teeth are irregularly spaced along each one of the at least four rectilinear edges, and each one of the four rectilinear edges supports four teeth spaced along each rectilinear edge.

11. The set of elements according to claim 9, wherein each said element of said set of elements has a general shape of a triangle and has only three rectilinear edges, each of said plurality of teeth has a substantially identical shape to one another and said plurality of teeth are irregularly spaced along each one of the at least three rectilinear edges, and each one of said three rectilinear edges supports at least four teeth spaced along each rectilinear edge.

12. A set of elements for being interconnected with one another in a mating relationship along rectilinear edges, said set of elements comprising a plurality of separate elements, and each said separate element comprising:

a planar member having at least three rectilinear edges, each one of said at least three rectilinear edges having a plurality of teeth located therealong, said plurality of teeth being located along each of said at least three rectilinear edges in an asymmetrical arrangement; and said plurality of teeth each having an identical width dimension measured along the rectilinear edge supporting said plurality of teeth;

a combined width dimension of all of said plurality of teeth, located along each one of said at least three rectilineal edges, being about one quarter of a total length dimension of each one of said three rectilinear edges to facilitate connection of at least three mating elements with one another along each one of said at least three rectilinear edges;

at least two of said plurality of teeth, provided along any one of said at least three rectilinear edges, being utilized for releasable locking engagement with at least two of said plurality of teeth of a mating element, of said set of elements, for lockingly interconnecting two mating elements with one another; and each of said plurality of teeth comprising two branches being separated from one another by a small longitudinal slot thereby forming two resilient branches.

13. The set of elements according to claim 12, wherein the plurality of teeth each have an identical width dimension, the width dimension constitutes a unit of measure of a free space separating said plurality of teeth along said rectilinear edges, and each of said rectilinear edges has an arrangement of the free space and said plurality of teeth which is disymmetrical with respect to a central plane bisecting the rectilinear edge.

14. The set of elements according to claim 12, wherein each said element of said set of elements has a general shape of a square and has four rectilinear edges and each one of the four rectilinear edges supports four teeth spaced along each rectilinear edge.

15. The set of elements according to claim 12, wherein each said element of said set of elements has a general shape of a triangle and has only three rectilinear edges and each one of said three rectilinear edges supports at least four teeth spaced along each rectilinear edge.

16. The set of elements according to claim 12, wherein each of said plurality of teeth has a substantially identical shape to one another and said plurality of teeth are irregularly spaced along each one of the at least three rectilinear edges.

* * * * *